US007715777B2

(12) United States Patent
Shirai et al.

(10) Patent No.: US 7,715,777 B2
(45) Date of Patent: May 11, 2010

(54) IMAGE FORMING APPARATUS FORMING A DEVELOPED IMAGE USING AN IMAGE CARRIER

(75) Inventors: Masaharu Shirai, Minamiashigara (JP); Nobuhide Inaba, Kanagawa (JP); Ryo Sekiguchi, Minamiashigara (JP); Toshie Furuya, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 134 days.

(21) Appl. No.: 12/078,145

(22) Filed: Mar. 27, 2008

(65) Prior Publication Data

US 2009/0035036 A1 Feb. 5, 2009

(30) Foreign Application Priority Data

Jul. 30, 2007 (JP) ..... 2007-197404

(51) Int. Cl.
*G03G 21/00* (2006.01)

(52) U.S. Cl. ..... 399/345; 399/71

(58) Field of Classification Search ..... 399/71, 399/345, 349, 343
See application file for complete search history.

(56) References Cited

U.S. PATENT DOCUMENTS 4,792,680 A 12/1988 Lang et al.
5,521,691 A * 5/1996 Morimoto et al. ..... 399/345 X
5,657,114 A * 8/1997 Kitajima et al. ..... 399/71
5,940,661 A * 8/1999 Yagi et al. ..... 399/343 X
2006/0133837 A1 * 6/2006 Shimojo et al. ..... 399/71

FOREIGN PATENT DOCUMENTS

| | | |
|---|---|---|
| JP | A-60-260069 | 12/1985 |
| JP | A-63-180977 | 7/1988 |
| JP | A-07-128955 | 5/1995 |
| JP | A-07-325528 | 12/1995 |
| JP | A-10-221928 | 8/1998 |
| JP | A-2004-301957 | 10/2004 |
| JP | 2006-178000 A * | 7/2006 |

* cited by examiner

*Primary Examiner*—Sophia S Chen
(74) *Attorney, Agent, or Firm*—Oliff & Berridge, PLC

(57) ABSTRACT

An image forming apparatus includes an image carrier; a charger that electrically charges the image carrier; an image forming section that forms an electrostatic latent image on the image carrier and develops the electrostatic latent image; a transferring-fixing section that transfers the image from the image carrier and fix the image onto a recording medium; a cleaning member; and a cleaning member moving section. The cleaning member cleans an unnecessary substance adhering onto a surface of the image carrier by abutting against the surface of the image carrier, and is capable of moving between an abutment position and a separation position where the cleaning member is separated from the image carrier. The cleaning member moving section moves the cleaning member from the separation position to the abutment position in accordance with a surface resistance of the surface of the image carrier.

14 Claims, 10 Drawing Sheets

IMAGE FORMING APPARATUS FORMING A DEVELOPED IMAGE USING AN IMAGE CARRIER

This application is based on and claims priority under 35USC 119 from Japanese Patent Application No. 2007-197407 filed Jul. 30, 2007.

BACKGROUND OF THE INVENTION

1. Field of the Invention

The present invention relates to an image forming apparatus where a developed image is formed on an image carrier, transferred from the image carrier, and fixed onto a recording medium.

2. Description of the Related Art

Image forming apparatuses such as predominantly a printer and a copying machine are widely prevailed in recent years, and therefore, there become widely available techniques relating to various elements constituting such an image forming apparatus. In a type adopting an electrophotographic system among various types of image forming apparatuses, an image carrier is electrically charged by the use of a charger, and then, a printing pattern is usually formed by forming an electrostatic latent image different in potential from the surroundings on the charged image carrier. The electrostatic latent image such formed as described above is developed with a developer agent containing a toner therein, and transferred onto a recording medium.

Since a high voltage is applied to the charger which conducts the electric charging, substance such as ozone or nitrogen oxide is secondarily produced from air around the charger with the application of the high voltage in many cases. If an unnecessary substance such as a discharged product adheres onto the image carrier, the charging performance of the image carrier is liable to be degraded. A marked degradation of the charging performance blurs an image formed on the recording medium, thereby causing the deterioration of a quality of an image (so-called image blurring).

SUMMARY OF THE INVENTION

The present invention has been made in view of the above circumstances and provides an image forming apparatus, in which an unnecessary substance adhering onto an image carrier is removed, as required, so as to achieve favorable image formation.

An image forming apparatus according to the present invention includes: an image carrier; a charger that applies an electric charge to the image carrier; an image forming section that forms an electrostatic latent image on the image carrier and forms a developed image by developing the electrostatic latent image; a transferring-fixing section that transfers the developed image from the image carrier and fix the image onto a recording medium; a cleaning member that cleans an unnecessary substance adhering onto a surface of the image carrier by abutting against the surface of the image carrier, the unnecessary substance being caused by the application of the electric charge by the charger, the cleaning member being capable of moving between an abutment position where the cleaning member abuts against the surface of the image carrier and a separation position where the cleaning member is separated from the image carrier; and a cleaning member moving section that moves the cleaning member from the separation position to the abutment position in accordance with a surface resistance of the surface of the image carrier.

DETAILED DESCRIPTION OF THE INVENTION

Explanation will be made below on exemplary embodiments according to the present invention.

Figure 1:
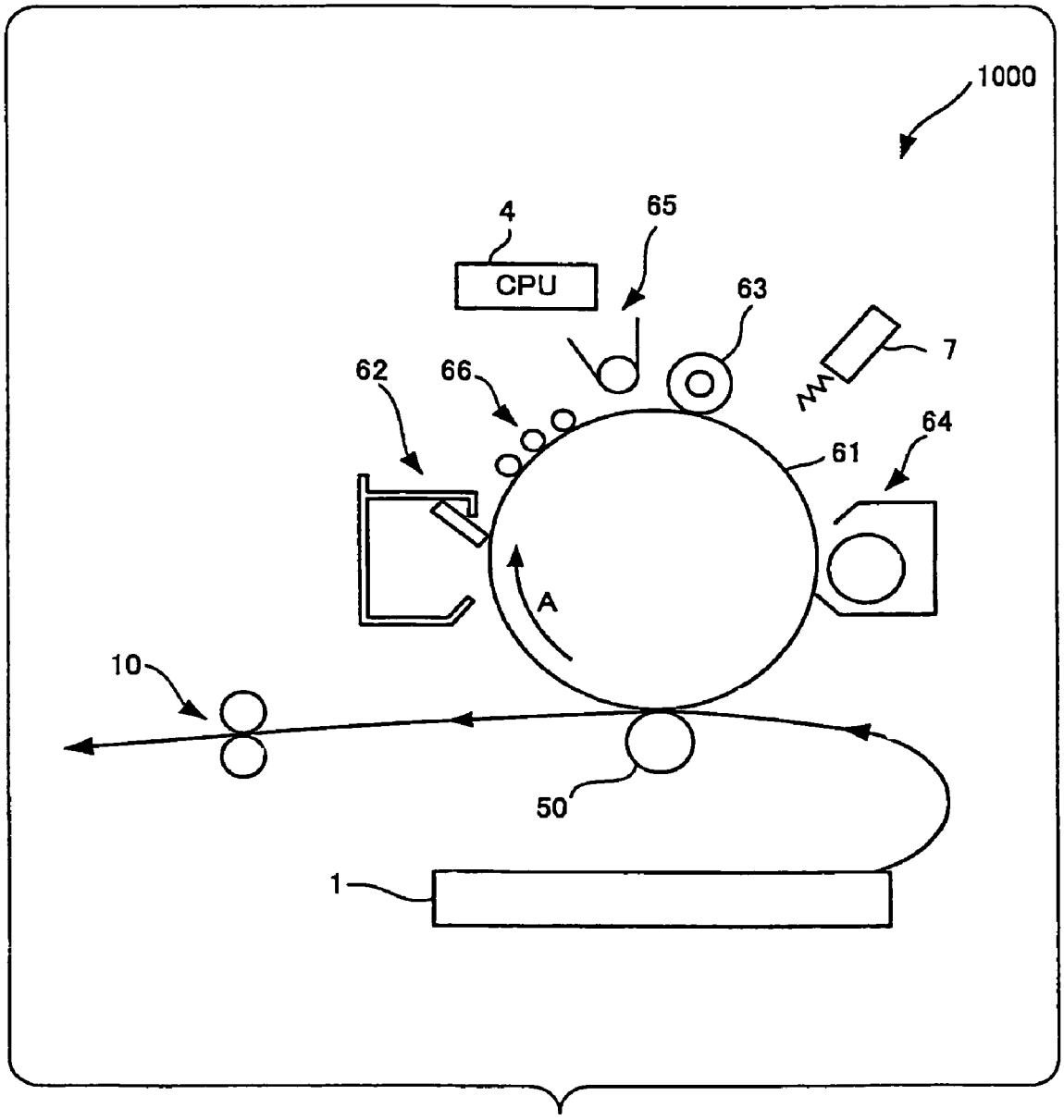
FIG. 1 is a diagram illustrating the schematic configuration of a full-color image forming apparatus in an embodiment of an image forming apparatus according to the present invention.

FIG. 1 is a diagram illustrating the general configuration of an image forming apparatus in an exemplary embodiment according to the present invention.

An image forming apparatus 1000 is a monochromatic one-sided output printer which adopts an electrophotographic system. The image forming apparatus 1000 is provided with a laminated type image carrier 61 for the electrophotographic system, which is rotated in a direction indicated by an arrow A in FIG. 1 during image formation, and a charger 63 which electrically charges the image carrier 61 by rotating in contact with the image carrier 61, upon the application of an AC voltage superimposed on a predetermined DC voltage by a charged voltage applying section which is not illustrated. Furthermore, the image forming apparatus 1000 includes: an exposing section 7 which emits a laser beam to the image carrier 61, so as to form, on the image carrier 61, an electrostatic latent image different in potential from the surroundings; a developing device 64 which allows a toner to adhere to the electrostatic latent image and forms a developed image by development; a transferring roll 50 which transfers the developed image formed on the image carrier 61 to a sheet to be transported with the application of a transferring bias voltage; a fixing device 10 which fixes a transferred image to the sheet by applying heat and pressure to the image transferred onto the sheet; a cleaning device 62 (corresponding to one example of a removing member according to the present invention) which removes a toner (i.e., a residual toner) adhering to and remaining on the image carrier 61 by a cleaning blade abutting against the image carrier 61, after the transfer of the developed image; a surface resistance-measuring device 66 which measures a surface resistance of the image carrier 61; a discharged product removing device 65 which removes a discharged product adhering onto the image carrier 61; and a CPU (Central Processing Unit) 4 which controls each of the component elements.

The image forming apparatus 1000 is further provided with a toner cartridge, not illustrated, which contains the toner therein and replenishes the toner in the developing device 64. Sheets, onto which developed images are transferred, are stacked in a tray 1. Upon instruction of image formation by a user, the sheet is transported from the tray 1, and then, is transported onto the left in FIG. 1 after the transfer of the developed image by the transferring roll 50. In FIG. 1, a sheet transportation path at this time is depicted by a channel indicated by leftward arrows. The sheet is transported on the sheet transportation path to the fixing device 10, in which the image transferred onto the sheet is fixed, and then, the sheet is output leftward.

In general, since a high voltage is applied to the charger at the time of the electric charging by the charger, the application of the high voltage frequently produces ozone from air around the charger, to secondarily produce substance such as oxide nitride. When such a discharged product adheres to the image carrier, the charging performance of the image carrier is liable to be deteriorated. A marked degradation of the charging performance blurs the image formed on the recording medium, thereby causing the degradation of the quality of the image (so-called image blurring).

Here, description will be given of a change in surface resistance of the image carrier which is attributable to the adhesion of the discharged product to the image carrier.

Figure 2:
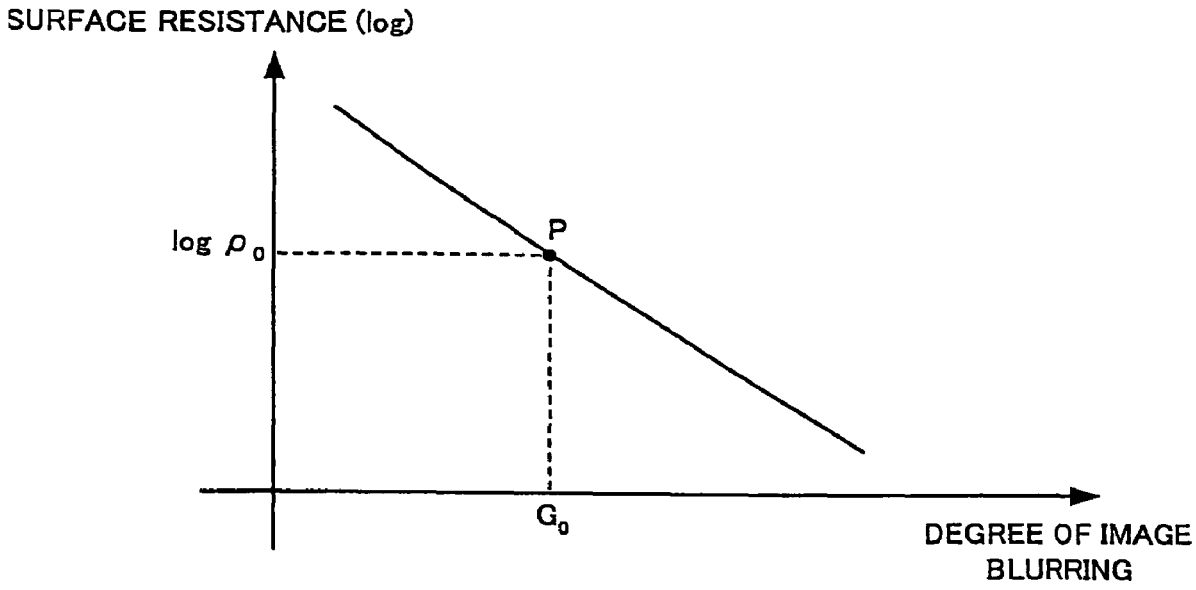
FIG. 2 is a graph illustrating the relationship between a surface resistance of an image carrier and a degree of image blurring.

FIG. 2 is a graph illustrating the relationship between the surface resistance of the image carrier and the degree of the image blurring.

In FIG. 2, the degree (i.e., the level) of the image blurring, which is obtained by observing the image, is adopted as a variable on a lateral axis. The image blurring becomes more conspicuous rightward in a direction in FIG. 2 along the lateral axis. In contrast, the common logarithm of the surface resistance of the image carrier is adopted as a variable on a vertical axis in FIG. 2. FIG. 2 is the graph illustrating the result obtained from experiments for examining the relationship between the surface resistance of the image carrier and the degree (i.e., the level) of the image blurring. FIG. 2 illustrates the relationship in which the surface resistance of the image carrier is decreased more as the level of the image blurring becomes higher. As a result, it is found from the graph that the surface resistance of the image carrier is decreased more as the amount of the discharged product adhered onto the image carrier becomes increased.

The image blurring concerned from the viewpoint of the image formation is so clearly observed as a deficiency of a quality of an image even by an ordinary user, as illustrated by a level $G_0$ or higher of the image blurring at a point P on the graph. The image blurring lower than the level $G_0$, if any, can be seldom recognized as the deficiency of the quality of the image by the ordinary user. The surface resistance at the point P on the graph is $\rho_0$ [Ω], which is set as a threshold, so that the image blurring raises a problem in the case where the surface resistance of the image carrier becomes $\rho_0$ or smaller.

In view of this, the surface resistance of the image carrier 61 is detected in the image forming apparatus 1000 illustrated in FIG. 1. If it is detected that the surface resistance is $\rho_0$ or smaller, the discharged product is removed. Hereinafter, explanation will be first made on the detection of the surface resistance of the image carrier 61, and subsequently, a description will be given of the discharged product removal.

Figure 3:
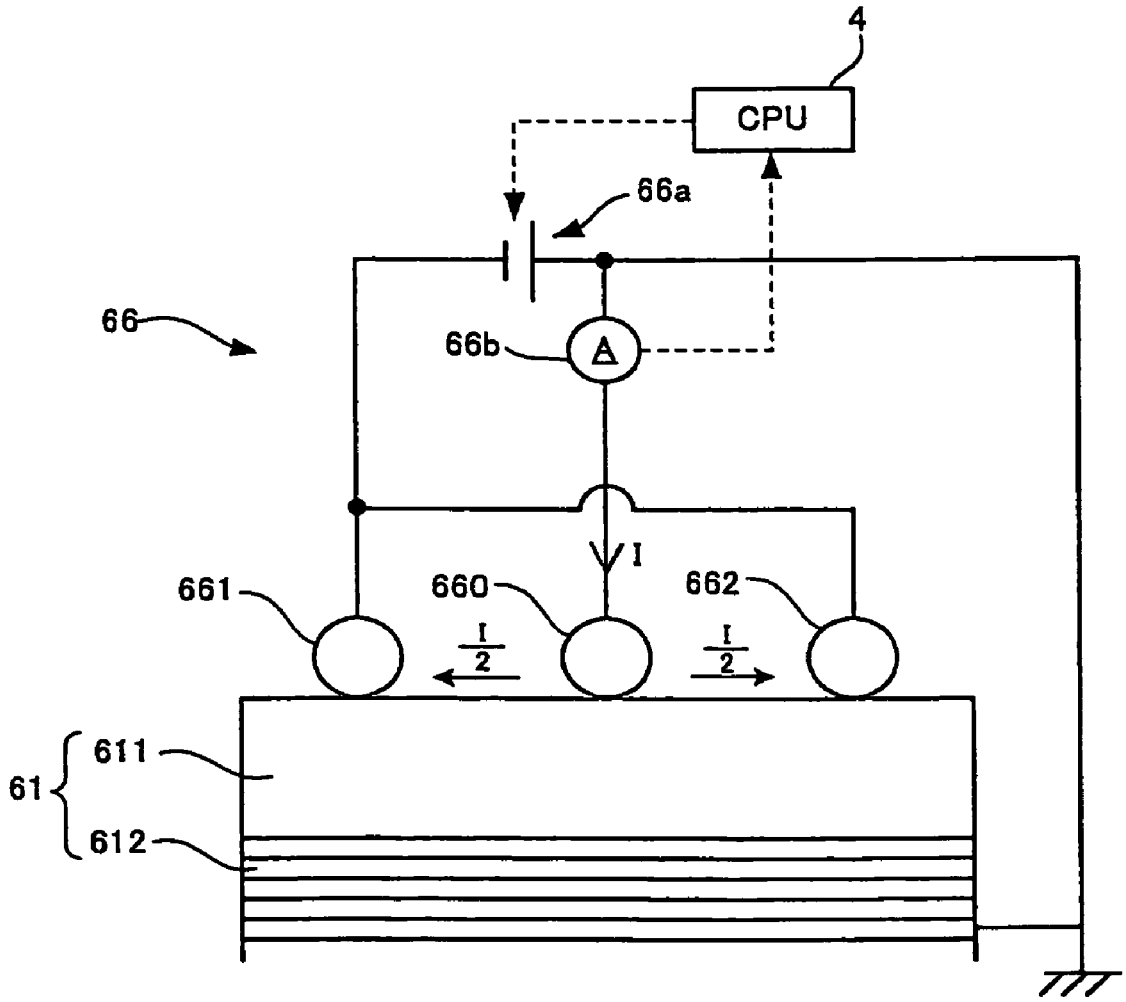
FIG. 3 is a diagram illustrating the schematic configuration of a surface resistance-measuring device for measuring a surface resistance of the image carrier illustrated in FIG. 1.

FIG. 3 is a diagram illustrating the schematic configuration of the surface resistance-measuring device 66 for measuring the surface resistance of the image carrier illustrated in FIG. 1.

The surface resistance-measuring device 66 illustrated in FIG. 1 includes three electrodes 660, 661 and 662 arranged along the surface of the image carrier 61, and an ammeter **66*b* for measuring a current flowing in the electrode 660 at a center of the three electrodes in FIG. 3. Each of the three electrodes 660, 661 and 662 is a columnar electrode having a predetermined length extending in a direction of a rotary shaft of the image carrier 61. The three electrodes 660, 661 and 662 are juxtaposed each other on the image carrier 61, to be rotated following the rotation of the image carrier 61. A circular cross section of each of the three electrodes is depicted in FIG. 3**.

Each of the three columnar electrodes is configured such that a cylindrical surface of a conductive columnar base is covered with an elastic layer, which is made of mainly a rubber material and contains a conductive agent therein, although not illustrated in FIG. 3. Further on the elastic layer is laminated a surface layer made of a resin containing a conductive agent therein in order to enhance abrasion durability. Materials of the base are exemplified by iron, bronze, aluminum, stainless and a resin containing a conductive agent therein. Among them, stainless is preferable from the viewpoint of durability. Materials of the elastic layer are exemplified by rubbers such as a silicon rubber, urethane, polybutadiene, polyisobutylene and an ethylene-propylene-diene rubber (abbreviated as "an EPDM"). The conductive agent contained in the elastic layer is exemplified by metallic particles made of carbon black, zinc or iron, or metallic oxide such as zinc oxide or tin dioxide. Materials of the surface layer are exemplified by an acrylic resin, a polyamide resin, a polyurethane resin and a polyester resin, in which the conductive agent is dispersed. The thickness of the elastic layer is preferably 1 mm or more and 4 mm or less, and more preferably, 2 mm or more and 3 mm or less. In the meantime, the thickness of the surface layer is preferably 10 μn or more and 500 μm or less, and more preferably, 10 μm or more and 200 μm or less.

The surface resistance-measuring device 66 illustrated in FIG. 3 is provided with a power source **66*a* for applying the same DC voltage between the center electrode 660 and the left electrode 661 and between the center electrode 660 and the right electrode 662 in FIG. 3. As for the power source 66*a*, the center electrode 660 is an anode whereas the left electrode 661 and the right electrode 662 are cathodes, wherein an anode side is grounded. The image carrier 61 in FIG. 3 is configured such that a photosensitive layer 611 for generating and transporting an electric charge is laminated on a metallic photosensitive base 612, which is grounded. With this configuration, the photosensitive base 612 is identical in potential to the center electrode 660 in FIG. 3. As a consequence, the current flowing into the center electrode 660 cannot flow into the photosensitive base 612 through the photosensitive layer 611. The current flowing into the center electrode 660 is half divided into a current flowing in the left electrode 661 and a current flowing in the right electrode 662, and thus, flows along the image carrier 61. Here, a distance from the center electrode 660 to the left electrode 661 in FIG. 3 is equal to a distance from the center electrode 660 to the right electrode 662 in FIG. 3. Consequently, an electric resistance at the surface of the image carrier 61** between the center electrode 660 and the left electrode 661 in FIG. 3 is equal to an electric resistance at the surface of the image carrier 61 between the center electrode 660 and the right electrode 662 in FIG. 3. Assuming that the electric resistance is designated by R [Ω], the resistance R is obtained by the following equation:

$$R=E/(I/2) \quad (1)$$

where E [V] denotes the magnitude of the power source 66*a* and I [A] expresses the magnitude of the current (i.e., the current flowing into the center electrode 660) measured by the ammeter 66*b*.

Here, the reason why the current I as a denominator on a right side is divided by 2 is that the current flowing into the center electrode 660 is half divided into the current flowing in the left electrode 661 and the current flowing in the right electrode 662, as described above.

Assuming that the surface resistance of the image carrier 61 is designated by ρ [Ω], the surface resistance ρ is determined by the following equation:

$$\rho=R\times(a/b) \quad (2)$$

where the resistance R is obtained by the equation (1), a [m] denotes the length of each of the three electrodes 660, 661 and 662 (the predetermined length extending in the direction of the rotary shaft of the image carrier 61), and b [m] designates the distance from the center electrode 660 to the left electrode 661 in FIG. 3 (also the distance from the center electrode 660 to the right electrode 662).

In combination of the equations (1) and (2), the surface resistance ρ is determined by the following equation:

$$\rho=2E\times(a/b)/I \quad (3)$$

The CPU 4 instructs the power source 66*a* in the surface resistance-measuring device 66 in FIG. 3 to apply the voltage between the electrodes immediately after the turning-on of the power source in the image forming apparatus 1000 and immediately after the completion of a series of image formation (i.e., jobs) instructed by the user, and then, acquires the current I measured by the ammeter 66*b* from the ammeter 66*b*. The CPU 4 determines the surface resistance ρ in accordance with the equation (2), and then, judges whether or not the resistance is the threshold $\rho_0$ or lower in reference to the graph in FIG. 2. If it is judged that the resistance ρ is not the threshold $\rho_0$ or lower, the CPU 4 leaves as it is. In contrast, if it is judged that the resistance ρ is the threshold $\rho_0$ or lower, the CPU 4 instructs the discharged product removing device 65 illustrated in FIG. 1 to remove the discharged product, described below.

Figure 4A:
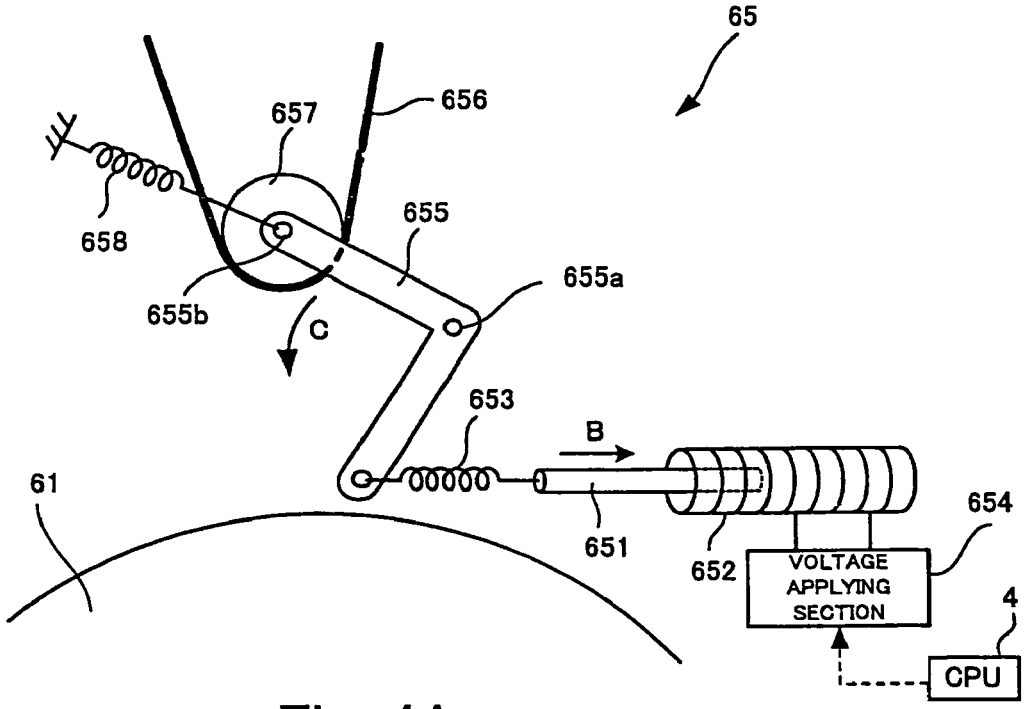
FIGS. 4A and 4B are diagrams illustrating a discharged product removing device illustrated in FIG. 1.
Figure 4B:
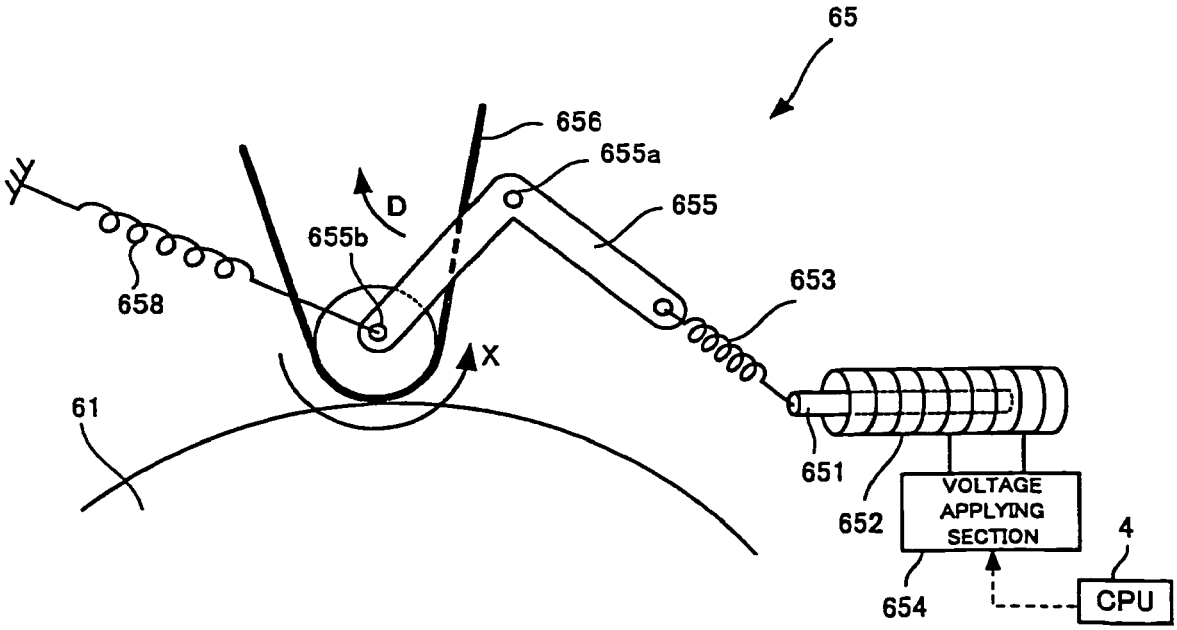

FIGS. 4A and 4B are diagrams illustrating the discharged product removing device illustrated in FIG. 1.

The discharged product removing device 65 is adapted to slide on the image carrier 61 in abutment of a web 656 against the surface of the image carrier 61. A web guide roll 657, around which the web 656 is stretched, is of a type which can rotate on a movable roll rotary shaft 655*b* extending in a direction perpendicular to the drawing and freely moving within a plane of the drawing, and therefore, the web guide roll 657 is moved within the plane of the drawing according to the movement of the movable roll rotary shaft 655*b*. The movable roll rotary shaft 655*b* can be moved between a web abutment position, at which the web 656 abuts against the surface of the image carrier 61, and a web separation position, at which the web is separated from the surface of the image carrier 61. FIG. 4A illustrates the movable roll rotary shaft 655*b* at the web separation position: in contrast, FIG. 4B illustrates the movable roll rotary shaft 655*b* at the web abutment position. Referring to FIGS. 4A and 4B, a description will be given below of a mechanism for moving the movable roll rotary shaft 655*b* between the web abutment position and the web separation position.

The web guide roll 657 is of a type which can be rotated on the movable roll rotary shaft 655*b* movable within the plane of the drawing. As illustrated in FIG. 4A, one end of an L shape of an L-shaped fitting 655 and a spring 658 are connected to the movable roll rotary shaft 655*b*. A fixed shaft 655*a* extending in a vertical direction in FIG. 4A penetrates the L-shaped fitting 655 at a point bent into an L shape at the L-shaped fitting 655. In this manner, the L-shaped fitting 655 can be rotated on the fixed shaft 655*a*. The other end of the L-shaped fitting 655 is connected to one end of a buffer spring 653: in contrast, the other end of the buffer spring 653 is secured to a ferromagnetic shaft 651. The metallic shaft 651 is such configured as to be moved leftward only at a predetermined position by a stopper member, not illustrated, although the metallic shaft 651 receives force exerting leftward in FIG. 4A from the buffer spring 653. FIG. 4A illustrates the shaft 651 which is moved most leftward in FIG. 4A. Here, the shaft 651 is partly inserted into a solenoid coil 652, which can be applied with a voltage from a voltage applying section 654 where the CPU 4 controls the voltage application. When the web guide roll 657 is located at the web abutment position, as illustrated in FIG. 4A, the solenoid coil 652 is applied with no voltage from the voltage applying section 654. In this state, the image is formed, as illustrated in FIG. 1. The CPU 4 instructs the voltage applying section 654 to apply the voltage to the solenoid coil 652 in the case where it is judged that the surface resistance ρ is the threshold $\rho_0$ or lower.

Upon the application of the voltage from the voltage applying section 654 to the solenoid coil 652, force is produced to pull the shaft 651 farther into the coil than the position illustrated in FIG. 4A by a magnetic field generated inside of the coil, so that the shaft 651 is moved in a direction indicated by an arrow B. When the shaft 651 is moved in the direction indicated by the arrow B, the end of the L-shaped fitting 655 connected to the buffer spring 653 is pulled rightward in FIG. 4A via the buffer spring 653, and thus, the L-shaped fitting 655 is rotated on the fixed shaft 655*a* in a direction indicated by an arrow C. With the rotation, the movable roll rotary shaft 655*b* connected to the L-shaped fitting 655 is moved downward in FIG. 4A together with the web guide roll 657 and the web 656 while allowing the spring 658 to expand, and finally, the movable roll rotary shaft 655*b* reaches a web abutment position illustrated in FIG. 4B. Here, in FIG. 4B, the web 656 is pressed against the image carrier 61 by the web guide roll 657 by force greater than the abutment force of the cleaning blade of the cleaning device 62 illustrated in FIG. 1 against the image carrier 61. A web winding-up device, not illustrated, is driven on the basis of an instruction from the CPU 4 in a state illustrated in FIG. 4B, and then, winds up the web 656, which wipes the surface of the image carrier 61, in a direction indicated by an arrow X. Here, when the web winding-up device is driven, the image carrier 61 also is driven to be rotated in the direction indicated by the arrow A in FIG. 1. The winding-up speed of the web 656 by the web winding-up device has been previously set in such a manner as to be different by predetermined percentage (e.g., ±0.5%) in proportion to the rotational speed of the image carrier 61. The web 656 wipes off the surface of the image carrier 61, thus satisfactorily removing the discharged product adhering onto the image carrier 61.

Since the particle diameter of the discharged product adhering onto the image carrier is generally smaller than that of a residual toner, the discharged product is less removed compared with the residual toner. In view of this, when the discharged product adhering onto the image carrier is removed, the cleaning blade needs to slide on the image carrier in abutment by force greater than the abutment force for use in removing the toner remaining on the image carrier (i.e., the residual toner) by the cleaning blade. The abutment force is too small to satisfactorily remove the discharged product, thereby causing a possibility of a deficient image with image blurring. It may be construed that the discharged product can be satisfactorily removed by increasing the abutment force of the cleaning blade. Usually, the cleaning blade abuts against the surface of the image carrier all the time in order to remove the residual toner. Therefore, if the abutment force of the cleaning blade is very great, the image carrier may be possibly abraded in turn. As a result, it is not preferable from the viewpoint of the quality of the image that the cleaning blade for removing the residual toner should also remove the discharged product as it is.

The image forming apparatus 1000 illustrated in FIG. 1 is provided with the discharged product removing device 65 adopting the system for wiping off the discharged product by causing the web 656 to abut against the surface of the image carrier independently of the cleaning device 62 for removing the residual toner. Consequently, the image forming apparatus 1000 can satisfactorily remove the discharged product by the abutment force suitable for the removal of the discharged product, thus avoiding any occurrence of the image blurring. Moreover, the discharged product is removed by causing the web 656 to abut against the surface of the image carrier 61 in the image forming apparatus 1000 only when so large quantity of discharged product as to raise the problem of the image blurring adheres onto the image carrier 61, so that the image carrier can be avoided from being abraded due to the unnecessary slide on the surface of the image carrier.

If the web 656 is pressed against the surface of the image carrier all the time or at a timing after the completion of a job irrespective of the quantity of discharged product adhering onto the image carrier 61, the web 656 may be smeared with the residual toner to degrade the removability of the discharged product by the discharged product removing device 65 at once in addition to the problem of the abrasion of the image carrier. Such a problem also can be solved in the image forming apparatus 1000. As a consequence, the removability of the discharged product can be maintained for a long period of time in the discharged product removing device 65 in the image forming apparatus 1000.

The web 656 having the predetermined length is wound up by the web winding-up device, thus completing the removal of the discharged product. Upon the completion of the removal, the CPU 4 instructs the voltage applying section 654 to stop the application of the voltage. As a result, the shaft 651 is moved leftward in FIG. 4B, so that the L-shaped fitting is rotated on the fixed shaft 655*a* in a direction indicated by an arrow D, to be returned to the state illustrated in FIG. 4A.

Although the discharged product removing system by the use of the web guide roll 657 having the winding-up type web 656 stretched therearound is adopted in the discharged product removing device 65, a discharged product removing system where a cleaning roll is caused to abut against the surface of the image carrier 61 may be adopted in place of the web guide roll 657 having the winding-up type web 656 stretched therearound according to the present invention. In this case, it is preferable that the discharged product should be removed while the cleaning roll is rotated at a rotational speed different by predetermined percentage (e.g., ±0.5%) from that of the image carrier 61.

Additionally, although the discharged product removing device 65 is disposed downstream of the surface resistance-measuring device 66 in the rotational direction of the image carrier 61 in the image forming apparatus 1000 illustrated in FIG. 1, the discharged product removing device may be disposed upstream of the surface resistance-measuring device in the rotational direction of the image carrier according to the present invention.

Although the surface resistance-measuring device 66 and the charger 63 are independent of each other in the image forming apparatus 1000, a contact type charger may serve as an electrode for the surface resistance-measuring device according to the present invention. Hereinafter, a description will be given of an image forming apparatus, in which a contact type charger serves as an electrode for a surface resistance-measuring device.

Figure 5:
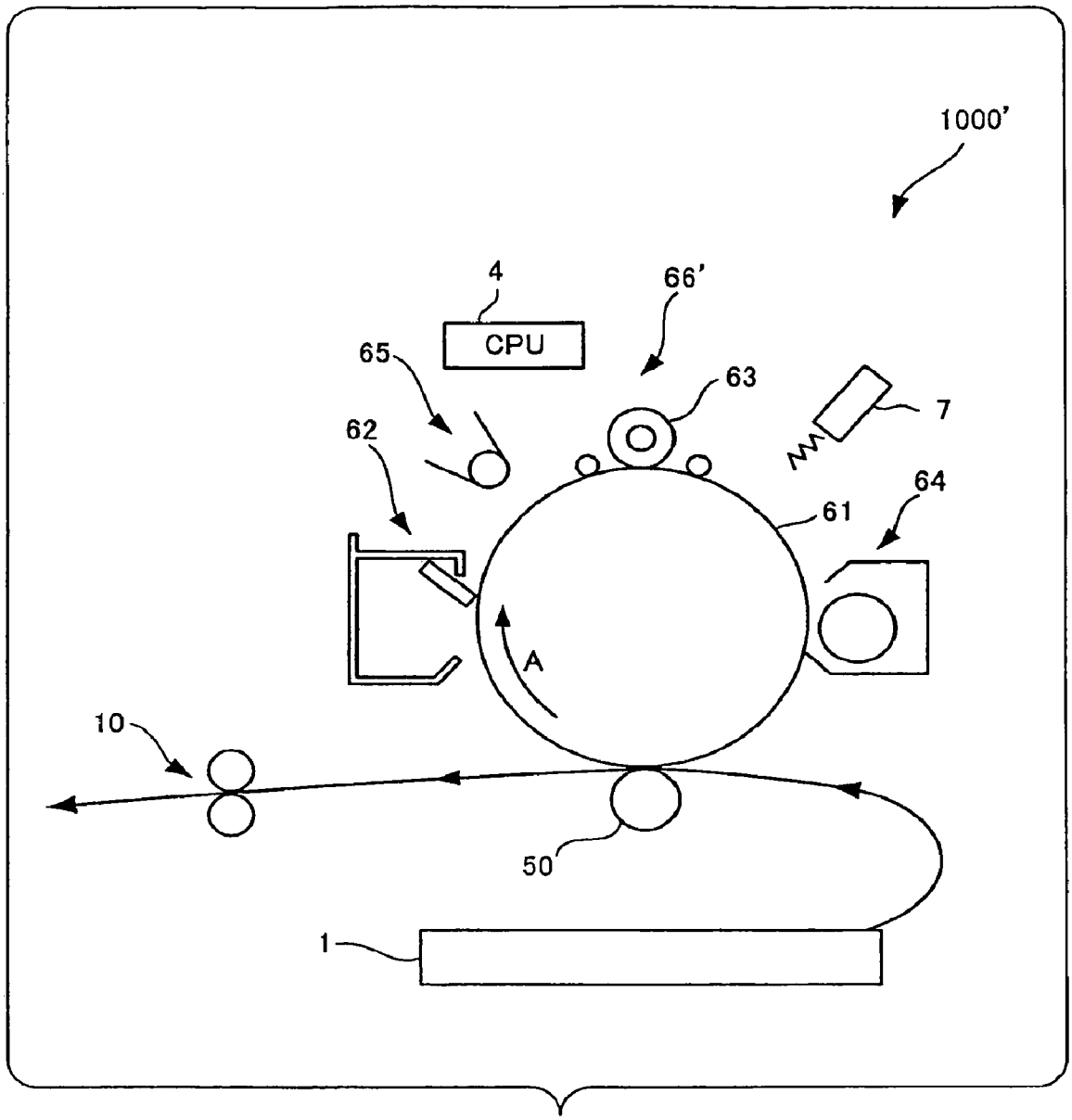
FIG. 5 is a diagram illustrating the general configuration of an image forming apparatus provided with a contact type charger which serves as an electrode in the surface resistance measuring device.

FIG. 5 is a diagram illustrating the general configuration of an image forming apparatus provided with a contact type charger which serves as an electrode in a surface resistance measuring device.

In a configuration of an image forming apparatus 1000' illustrated in FIG. 5, the same constituent elements as those in the image forming apparatus 1000 illustrated in FIG. 1 are designated by the same reference numerals, and therefore, a duplicate explanation will be omitted below.

In the image forming apparatus 1000' illustrated in FIG. 5, a contact type charger 63 serves as a device for electrically charging an image carrier 61, and further, functions as one of three electrodes included in a surface resistance-measuring device 66'. Here, generating sources of a voltage to be supplied to the charger 63 illustrated in FIG. 5 are switched in electrically charging the image carrier 61 and in measuring a surface resistance of the image carrier 61, as described below.

Figure 6:
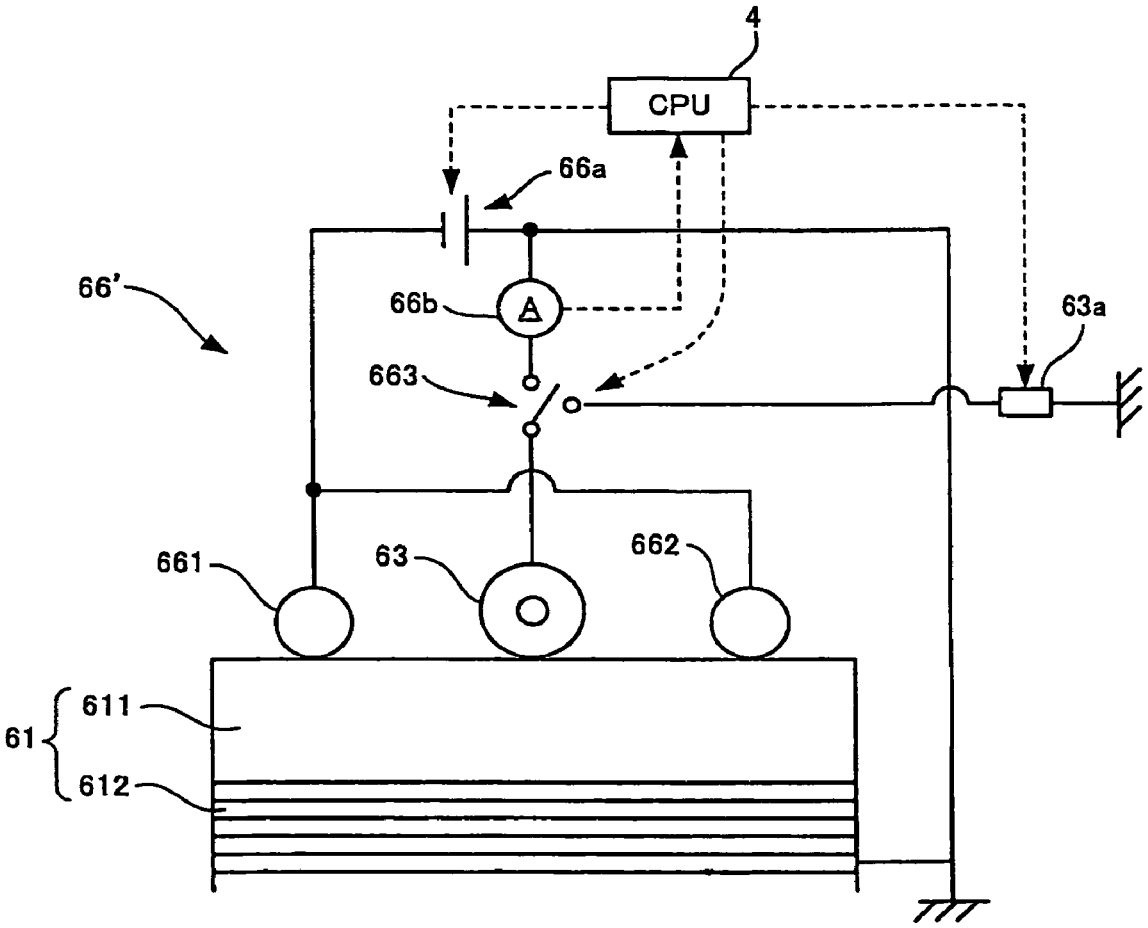
FIG. 6 is a diagram illustrating the schematic configuration of the surface resistance-measuring device illustrated in FIG. 5.

FIG. 6 is a diagram illustrating the schematic configuration of the surface resistance-measuring device 66' illustrated in FIG. 5.

In the configuration of the surface resistance-measuring device 66' illustrated in FIG. 6, the same constituent elements as those in the surface resistance-measuring device 66 illustrated in FIG. 3 are designated by the same reference numerals, and therefore, a duplicate explanation will be omitted below. The configuration of the surface resistance-measuring device 66' illustrated in FIG. 6 is different from that of the surface resistance-measuring device 66 illustrated in FIG. 3 in that the center electrode 660 out of the three electrodes included in the surface resistance-measuring device 66 illustrated in FIG. 3 is replaced with the contact type charger 63 in the surface resistance-measuring device 66' illustrated in FIG. 6 and that the 'surface resistance-measuring device 66' is provided with a switch 663 for switching a generating source of a voltage to be supplied to the charger 63. The switch 663 is turned on or off under the control by the CPU 4. The CPU 4 controllably switches the switch 663, so as to allow a charged voltage applying section 63*a* to apply an AC voltage, which is superimposed on a predetermined DC voltage, to the charger 63 when the image carrier 61 is electrically charged during the image formation: whereas a DC source 66*a* is caused to apply a DC voltage to the charger 63, as also described in reference to FIG. 3, when the surface resistance of the image carrier 61 is measured. Here, the charger 63 illustrated in FIG. 6 is formed into a columnar shape extending in a direction of a rotary shaft for the image carrier 61, like the center electrode 660 illustrated in FIG. 3, and further, the length and position are identical to those of the center electrode 660 illustrated in FIG. 3. Thus, the surface resistance-measuring device 66' illustrated in FIG. 6 also measures the surface resistance of the image carrier 61 based on the equation (3) in the same manner as described in reference to FIG. 3. Therefore, the duplicate-explanation will be omitted below.

The configuration of the surface resistance-measuring device is devised such that the current (i.e., the current measured by the ammeter) flowing toward the image carrier does not flow into the image carrier but flows only at the surface of the image carrier in the image forming apparatuses 1000 and 1000', as described above (see FIG. 3). However, even if the configuration of the surface resistance-measuring device is not devised, an image forming apparatus may detect the degree of the adhesion of the discharged product onto the image carrier, giving priority to the simplification of the configuration of the apparatus according to the present invention. The current flows into the image carrier in the not-devised apparatus, with an attendant degradation of accuracy in comparison with the system illustrated in FIG. 3: in contrast, the configuration of the device can be simplified, with an attendant advantage of cost reduction or miniaturization.

Hereinafter, explanation will be made on an image forming apparatus including a simplified device which detects the degree of adhesion of a discharged product.

Figure 7:
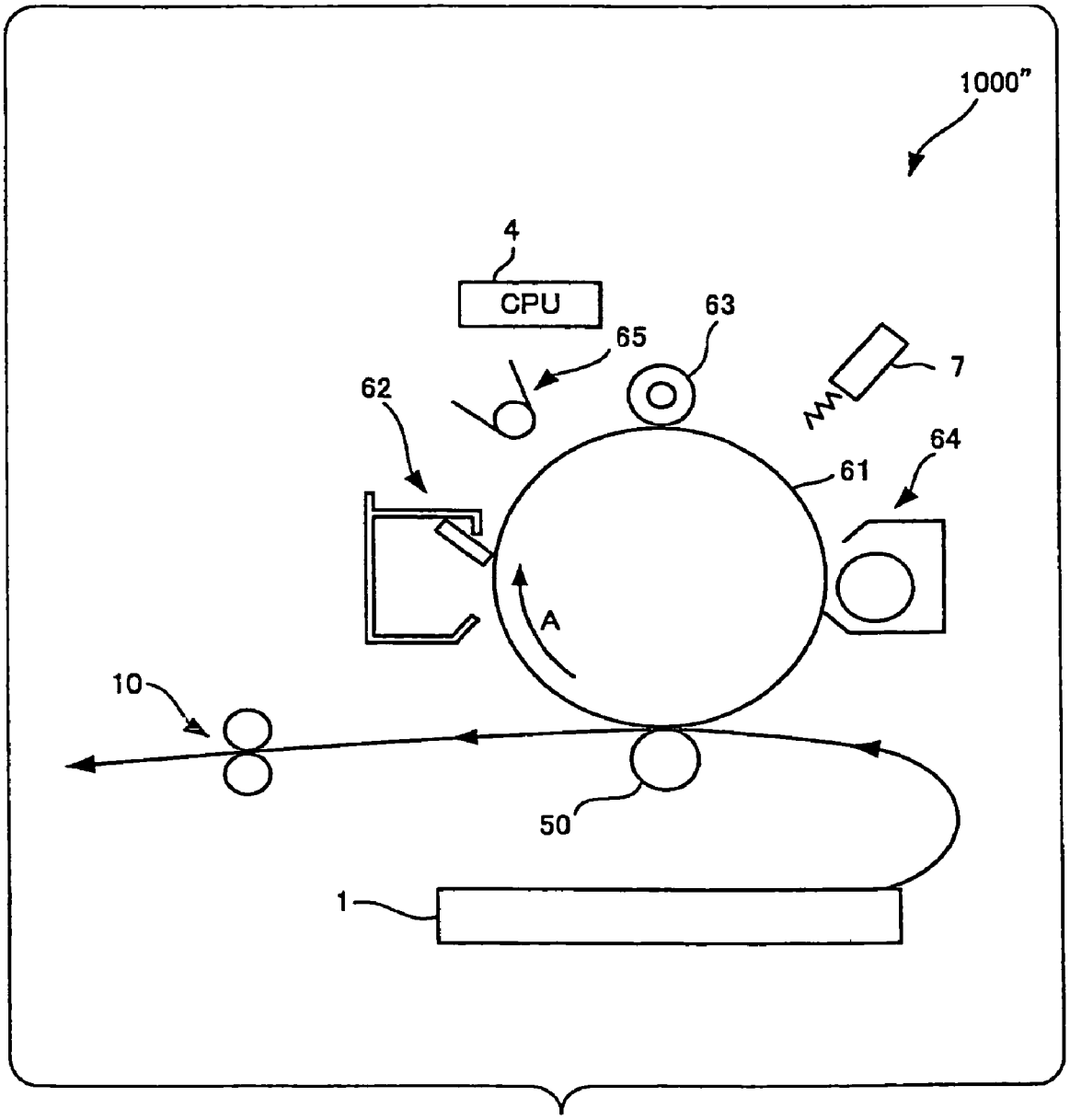
FIG. 7 is a diagram illustrating the general configuration of an image forming apparatus including simplified detecting device that detects the degree of adhesion of a discharged product.

FIG. 7 is a diagram illustrating the general configuration of an image forming apparatus including a simplified device which detects the degree of adhesion of a discharged product.

In a configuration of an image forming apparatus 1000" illustrated in FIG. 7, the same constituent elements as those in the image forming apparatus 1000' illustrated in FIG. 5 are designated by the same reference numerals, and therefore, a duplicate explanation will be omitted below.

In the image forming apparatus 1000" illustrated in FIG. 7, a contact type charger 63 serves as a device for electrically charging an image carrier 61, and further, functions as an electrode for measuring the magnitude of a current flowing toward the image carrier. At this point, the image forming apparatus 1000" illustrated in FIG. 7 is identical to the image forming apparatus 1000' illustrated in FIG. 5. However, the electrode is only one, that is, the charger 63 in the image forming apparatus 1000" illustrated in FIG. 7, unlike the image forming apparatus 1000' illustrated in FIG. 5.

Figure 8:
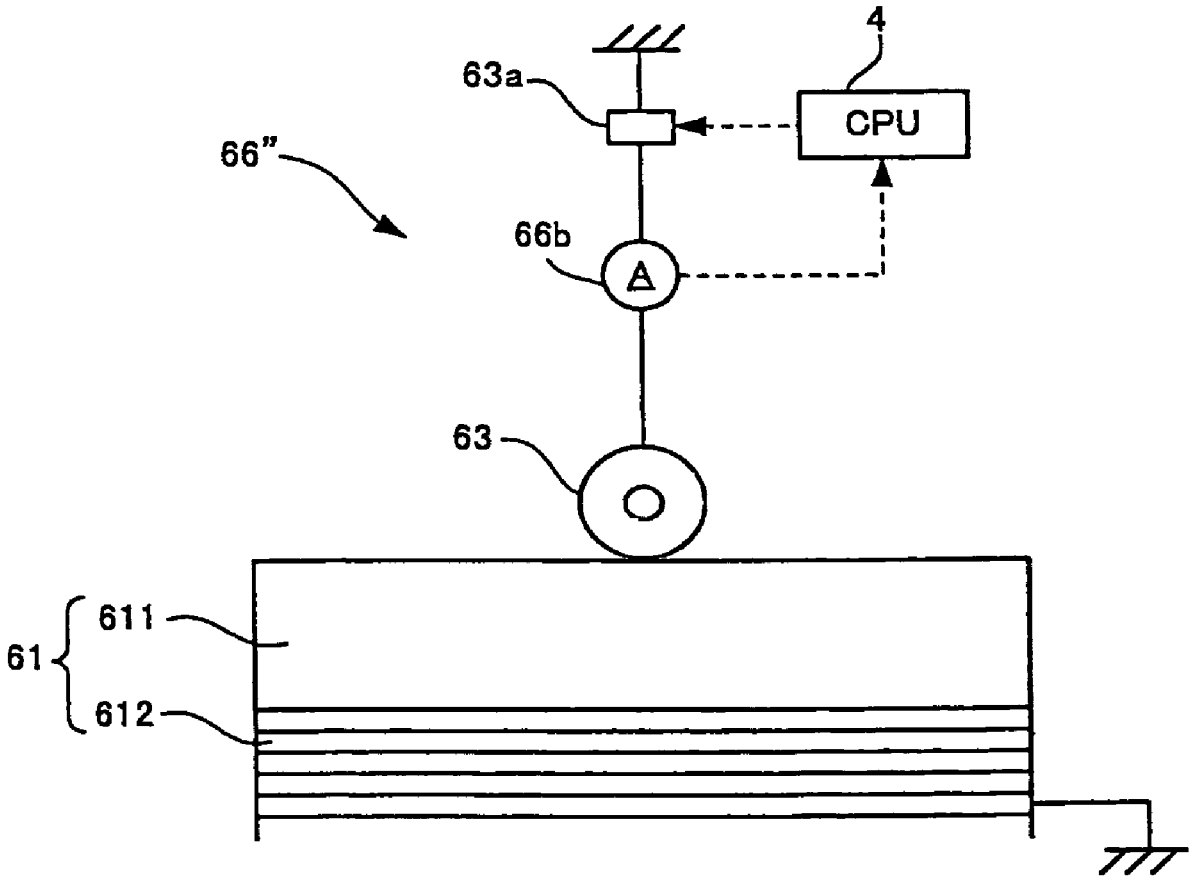
FIG. 8 is a diagram illustrating the schematic configuration of a detecting device that detects a degree of adhesion of a discharged product and that is provided in an image forming apparatus 1000" illustrated in FIG. 7.

FIG. 8 is a diagram illustrating the schematic configuration of a detecting device for detecting a degree of adhesion of a discharged product, provided in the image forming apparatus 1000" shown in FIG. 7.

In the configuration of a detecting device 66" illustrated in FIG. 8, the same constituent elements as those in the detecting device 66' illustrated in FIG. 6 are designated by the same reference numerals. A charged voltage applying section 63*a* for applying an AC voltage, which is superimposed on a predetermined DC voltage, to the charger 63 in electrically charging the image carrier 61 in the detecting device 66" illustrated in FIG. 8 applies DC voltage for current measurement to the charger 63 in measuring the current flowing toward the image carrier. Here, a CPU 4 controls the charged voltage applying section 63*a*. The current flowing toward the image carrier 61 flows into a photosensitive base 612 through a photosensitive layer 611 in the detecting device 66" illustrated in FIG. 8. Here, if a large quantity of discharged product adheres onto the image carrier 61, the current is liable to flow along the surface of the image carrier 61. Therefore, the current flowing in the image carrier 61 from the charger 63 flows into the photosensitive base 612 through the photosensitive layer 611 while being dispersed around the charger 63 in a lateral direction in FIG. 8. As a consequence, as the larger quantity of discharged product adheres onto the image carrier 61, the larger quantity of current flows into the photosensitive base 612 through the photosensitive layer 611. In other words, a passing cross-sectional area when the current flows the photosensitive layer 611 is enlarged, thereby decreasing an effective resistance of the photosensitive layer 611 acting as an electric resistance. Here, the magnitude of the current flowing into the photosensitive base 612 through the photosensitive layer 611 is measured by an ammeter 66*b*.

Figure 9:
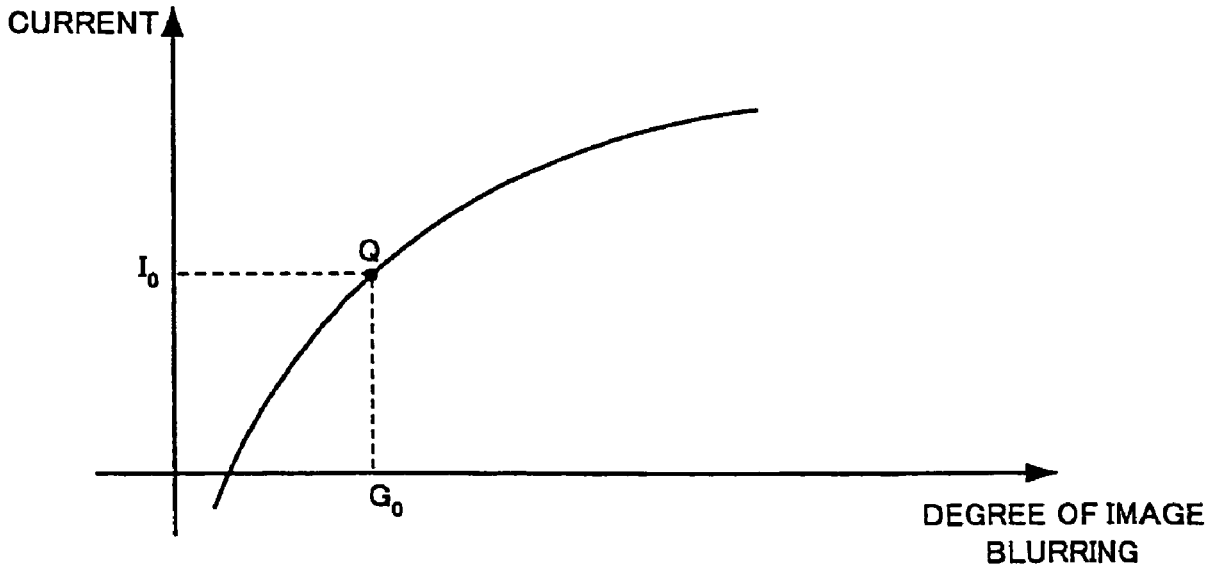
FIG. 9 is a graph illustrating the relationship between a current flowing into a base through a photosensitive layer from an electrode placed on the image carrier and the degree of the image blurring.

FIG. 9 is a graph illustrating the relationship between the current flowing into the base through the photosensitive layer from the electrode placed on the image carrier and the degree of the image blurring.

FIG. 9 is a graph illustrating the relationship between the current and the degree (i.e., the level) of the image blurring when the degree (i.e., the level) of the image blurring is adopted as a variable on a lateral axis: in contrast, the magnitude of the current flowing into the base through the photosensitive layer from the electrode mounted on the carrier is adopted as a variable on a vertical axis. FIG. 9 illustrates that the current flowing into the base through the photosensitive layer is increased more as the level of the image blurring becomes higher. As a result, it is found from the graph that the current flowing into the base through the photosensitive layer is increased more as the amount of the discharged product adhered onto the image carrier becomes increased.

The image blurring which is clearly observed as the deficiency of the quality of the image, as described in reference to FIG. 2, raises the problem from the viewpoint of the image formation when the image blurring becomes $G_0$ or higher at the point P on the graph. Therefore, the image blurring raises a problem in the case where the current becomes $I_0$ or higher at a point Q on the graph.

In view of this, the CPU 4 illustrated in FIG. 8 judges whether or not the current measured by the ammeter 66*b* becomes a threshold $I_0$ or higher. If it is judged that the current measured by the ammeter 66*b* becomes the threshold $I_0$ or higher, the CPU 4 instructs the discharged product removing device 65 illustrated in FIG. 7 (which is the same as that illustrated in FIG. 4) to remove a discharged product. The removal of the discharged product is conducted in the same manner as described in reference to FIG. 4, and therefore, a duplicate explanation will be omitted below.

In other words, the detecting device illustrated in FIG. 8 detects that the current flowing into the image carrier becomes $I_0$ or higher, thus indirectly detecting that the surface resistance of the image carrier becomes the threshold $\rho_0$ or smaller, as described above in reference to FIG. 2. Based on the detection result, the discharged product is removed.

The discharged product removing device 65 for wiping off the discharged product by the web is adopted in removing the discharged product in the image forming apparatuses 1000, 1000' and 1000". However, the cleaning device for removing the residual toner by the use of the cleaning blade also serves as the discharged product removing device according to the present invention. Therefore, there may be adopted a cleaning device for switching an abutment force in such a manner that the cleaning blade in removing the discharged product abuts against the image carrier with an abutment force stronger than that in removing the residual toner.

An image forming apparatus adopting such a cleaning device is identical in configuration to the image forming apparatus 1000 illustrated in FIG. 1 except that there is no discharged product removing device 65 since the cleaning device for removing the residual toner serves as also the discharged product removing device. Explanation will be omitted on the same constituent elements, but will be made on the switch of the abutment force of the cleaning blade by the cleaning device.

Figure 10A:
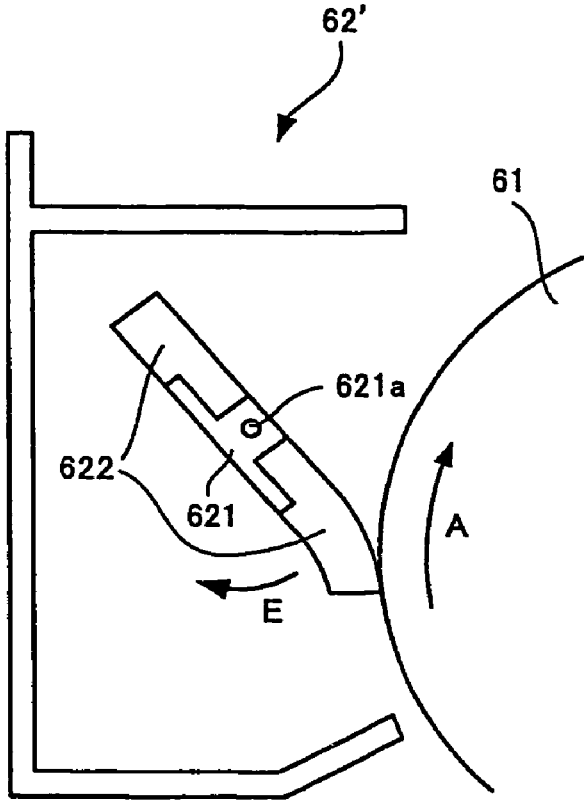
FIGS. 10A and 10B are diagrams illustrating a manner in which an abutment force of a cleaning blade is switched.
Figure 10B:
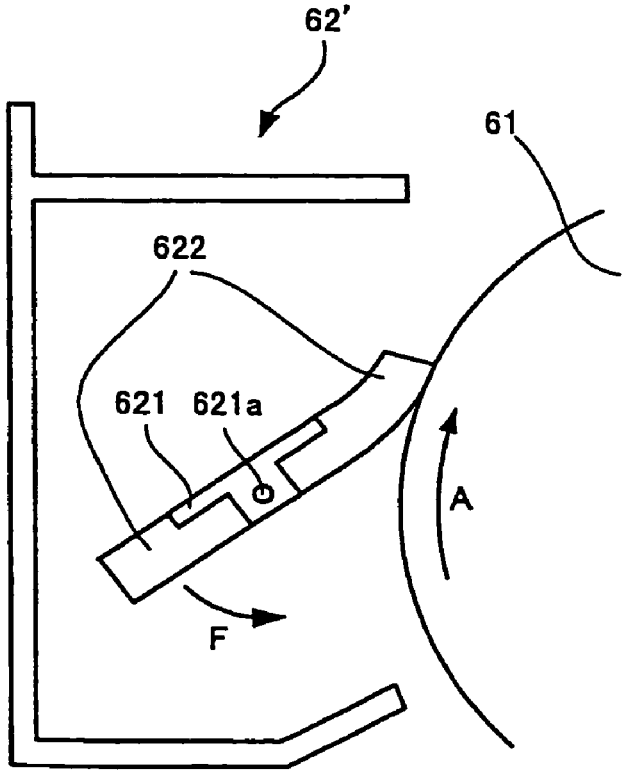

FIGS. 10A and 10B are diagrams illustrating a manner in which an abutment force of a cleaning blade is switched.

FIG. 10A illustrates a state in which a cleaning blade 622 disposed in a cleaning device 62' removes a residual toner. The cleaning blade 622 is a plate-like member which extends in a direction perpendicular to FIGS. 10A and 10B and is made of an urethane rubber, and further, is supported by a supporting member 621 at one plane and side surfaces of the plate. FIGS. 10A and 10B illustrate the cleaning blade 622, as viewed sideways. The supporting member 621 receives a rotational drive force from a motor, not illustrated, and then, can be rotated on a rotary shaft 621*a* extending in the direction perpendicular to FIGS. 10A and 10B. The cleaning blade 622 also is rotated together with the rotation of the supporting member 621. The motor is controlled by a CPU (Central Processing Unit), not illustrated in FIGS. 10A and 10B. The CPU controls the motor so as to rotate the cleaning blade 622 in a direction indicated by an arrow E in FIG. 10A in the case where a surface resistance measured by a surface resistance-measuring device is the threshold $\rho_0$ or smaller, as described above in reference to FIG. 2.

When the cleaning blade 622 is rotated in the direction indicated by the arrow E, an end of the cleaning blade 622 that abuts against the surface of an image carrier 61 (i.e., a right end in FIG. 10A) in a state illustrated in FIG. 10A is separated from the image carrier 61, and then, the other end of the cleaning blade 622 in separation from the image carrier 61 (i.e., a left end in FIG. 10A) in the state illustrated in FIG. 10B abuts against the surface of the image carrier 61. FIG. 10B illustrates a state after the end of the cleaning blade 622 that abuts against the surface of the image carrier 61 is switched in the above-described manner. A discharged product is removed in the state illustrated in FIG. 10B. The CPU controls the drive force of the motor, not illustrated, in such a manner that an abutment force by the cleaning blade 622 against the surface of the image carrier 61 in removing the discharged product becomes larger than that in removing a residual toner.

The abutment end of the cleaning blade 622 abuts against the image carrier 61 in a direction (i.e., downward in FIG. 10A) opposite to a movement direction (i.e., a direction indicated by an arrow A in FIG. 10A) of the image carrier 61 in the state illustrated in FIG. 10A. In contrast, the abutment end of the cleaning blade 622 abuts against the image carrier 61 in the same direction (i.e., upward in FIG. 10B) as the movement direction (i.e., the direction indicated by the arrow A in FIG. 10A) of the image carrier 61 in the state illustrated in FIG. 10B. A tip of the cleaning blade 622 that abuts against the image carrier 61 slides on the image carrier 61 by hooking on the surface of the moving image carrier 61 in the state illustrated in FIG. 10A, thus producing a more favorable effect in removing an unnecessary substance having a large particle diameter such as the residual toner adhering onto the image carrier 61 in comparison with that in the state illustrated in FIG. 10B. However, a stick slip is liable to occur due to the elasticity of the cleaning blade 622 in the state illustrated in FIG. 10B. As a consequence, an unnecessary substance having a small particle diameter such as the discharged product passes through the cleaning blade 622, and therefore, the unnecessary substance having the small particle diameter cannot be satisfactorily removed in many cases. In contrast, the cleaning blade 622 hardly causes any stick slip so as to be suitable for the removal of the unnecessary substance having the small particle diameter such as the discharged product in the state illustrated in FIG. 10B in comparison with the state illustrated in FIG. 10A. In view of this, the cleaning device 62' performs the removal in the state illustrated in FIG. 10A in the case where the unnecessary substance to be removed is the residual toner, whereas the removal is performed in the state illustrated in FIG. 10B in the case where the unnecessary substance to be removed is the discharged product. Thus, both of the residual toner and the discharged product are satisfactorily removed.

Here, the abutment force of the cleaning blade 622 against the surface of the image carrier 61 at the time of the removal of the discharged product preferably should be 1.05 times or more and 1.20 times or less the abutment force at the time of the removal of the residual toner, and more preferably, 1.07 times or more and 1.15 times or less. Furthermore, in order to enhance the discharged product removing effect, an abrasive made of ceric oxide or the like may be dispersed in the tip of the cleaning blade that abuts against the surface of the image carrier 61 at the time of the removal of the discharged product. In this case, it is preferable to disperse the abrasive within a range from 10% or more to 20% or less by a volumetric content.

The removal of the discharged product is completed by predetermined times of rotations of the image carrier 61 in the state illustrated in FIG. 10B. Upon the completion of the removal, the CPU controls the motor, so as to rotate the supporting member 621 in a direction indicated by an arrow F in FIG. 10B. Consequently, the cleaning blade 622 is returned again to the abutment state in preparation for the removal of the residual toner, as illustrated in FIG. 10A.

Hereinafter, a description will be given, on the basis of experiment results, of the discharged product which is removed by directly or indirectly detecting that the surface resistance of the image carrier becomes a predetermined threshold or less, thus actually avoiding any occurrence of the image blurring.

EXAMPLE 1

An image forming apparatus in Example 1 is configured in the same manner as the image forming apparatus 1000 illustrated in FIG. 1. In the image forming apparatus, an electrode formed by laminating elastic layers made of an epichlorohydrin rubber obtained by dispersing a conductive agent incorporating a quaternary ammonium salt or carbon black in a stainless base is used as each of three electrodes mounted on an image carrier. Moreover, the rotational speed of a web at the time of removal of a discharged product has a difference by about 0.5% from that of the image carrier. In the image forming apparatus, a common logarithm of a surface resistance as a threshold is 14 [log Ω] at the time of the removal of the discharged product, which is equivalent to $10^{14}$ [Ω] of the surface resistance $\rho_0$ illustrated in FIG. 2. A job which sequentially outputs 50 sheets of a predetermined image is repeated 100 times by the use of the image forming apparatus in Example 1. In the image forming apparatus in Example 1, the surface resistance of the image carrier is detected upon the completion of each of the jobs. As a result, when the surface resistance became $10^{14}$ [Ω] or less, the discharged product is removed by causing the web to abut against the surface of the image carrier.

An examination of the occurrence of image blurring on the image first output in each of the jobs revealed no occurrence of the image blurring which raised a problem from the viewpoint of the quality of the image.

EXAMPLE 2

An image forming apparatus in Example 2 is configured in the same manner as the image forming apparatus 1000" illustrated in FIG. 7. In the image forming apparatus, the rotational speed of a web at the time of removal of a discharged product has a difference by about 0.5% from that of an image carrier. In the image forming apparatus, a current as a threshold is 0.4 [μA] at the time of the removal of the discharged product, which is equivalent to the current $I_0$ of 0.4 [μA] illustrated in FIG. 2. A job which sequentially outputs 50 sheets of a predetermined image is repeated 100 times in the same manner as in Example 1 by the use of the image forming apparatus in Example 2. In the image forming apparatus in Example 2, the current flowing into the image carrier is measured upon the completion of each of the jobs. As a result, when the current became 0.4 [μA] or higher, the discharged product is removed by causing the web to abut against the surface of the image carrier.

An examination of the occurrence of image blurring on the image first output in each of the jobs revealed no occurrence of the image blurring which raised a problem from the viewpoint of the quality of the image.

COMPARATIVE EXAMPLE 1

An image forming apparatus in Comparative Example 1 is configured in the same manner as the image forming apparatus 1000 illustrated in FIG. 1 except that there are provided neither a device for measuring a surface resistance of an image carrier nor a discharged product removing device. In the image forming apparatus, a cleaning blade disposed in a cleaning device abuts against the surface of the image carrier all the time. A job which sequentially outputs 50 sheets of a predetermined image is repeated 100 times in the same manner as in Example 1 by the use of the image forming apparatus in Comparative Example 1.

As a result of an examination of the occurrence of image blurring on the image first output in each of the jobs, a deficiency of a quality of an image clearly regarded as image blurring is markedly observed particularly in the latter half of the 100 jobs.

The results of Example 1, Example 2 and Comparative Example 1 can conclude as follows: the degree of the adhesion of the discharged product onto the image carrier is examined upon the completion of the job, and then, the discharged product is wiped off in the case of the adhesion of the discharged product in a large quantity, so that the occurrence of the image blurring can be effectively avoided, like in Example 1 and Example 2.

Incidentally, although the image forming apparatuses, described above, are monochromatic one-sided output printers, the image forming apparatus according to the present invention may be applied to a monochromatic double-sided output printer, a full-color one- or double-sided output printer, or a facsimile.

What is claimed is:

1. An image forming apparatus comprising:

an image carrier;

a charger that applies an electric charge to the image carrier;

an image forming section that forms an electrostatic latent image on the image carrier and forms a developed image by developing the electrostatic latent image;

a transferring-fixing section that transfers the developed image from the image carrier and fix the image onto a recording medium;

a cleaning member that cleans an unnecessary substance adhering onto a surface of the image carrier by abutting against the surface of the image carrier, the unnecessary substance being caused by the application of the electric charge by the charger, the cleaning member being capable of moving between an abutment position where the cleaning member abuts against the surface of the image carrier and a separation position where the cleaning member is separated from the image carrier; and a cleaning member moving section that moves the cleaning member from the separation position to the abutment position in accordance with a surface resistance of the surface of the image carrier.

2. The image forming apparatus according to claim 1, wherein the cleaning member moving section carries out a predetermined measurement on the surface of the image carrier and thereby determines a level of a surface resistance of the surface and, moves the cleaning member from the separation position to the abutment position when the measured level is decreased down to a predetermined level or lower.

3. The image forming apparatus according to claim 1, wherein the cleaning member moving section measures a current flowing in a direction within the surface of the image carrier and determines a level of the surface resistance based on a measurement result.

4. The image forming apparatus according to claim 1, wherein the cleaning member moving section further comprises:

a plurality of electrode members that abut against the surface of the image carrier respectively at spaced positions on the surface;

a voltage applying section that applies a voltage between the plurality of electrode members; and a current measuring section that measures a current flowing between the plurality of electrode members, wherein a level of the surface resistance is determined based on the current measurement result by the current measuring section.

5. The image forming apparatus according to claim 4, wherein the cleaning member moving section moves the cleaning member from the separation position to the abutment position when the determined level of the surface resistance is lower than a predetermined specific level.

6. The image forming apparatus according to claim 4, wherein the charger applies an electric charge to the image carrier by abutting against the image carrier, and the cleaning member moving section uses the charger as one of the plurality of electrode members.

7. The image forming apparatus according to claim 1, wherein the charger applies an electric charge to the image carrier by abutting against the image carrier, the cleaning member moving section comprises a current measuring section that measures a current flowing between the charger and the image carrier following the application of the electric charge by the charger, and a level of the surface resistance is determined based on the current measurement result by the current measuring section.

8. The image forming apparatus according to claim 1, further comprising a removing member that removes the developed image remaining on the image carrier after the developed image is transferred from the image carrier.

9. An image forming apparatus comprising:

an image carrier that has a base and a photosensitive layer;

a charger that applies an electric charge to the image carrier;

an image forming section that forms an electrostatic latent image on the image carrier and forms a developed image by developing the electrostatic latent image;

a transferring-fixing section that transfers the developed image from the image carrier and fixes the image onto a recording medium;

a cleaning member that cleans an unnecessary substance adhering onto a surface of the image carrier by abutting against the surface, the unnecessary substance being caused by the application of the electric charge by the charger, the cleaning member being capable of moving between an abutment position where the cleaning member abuts against the surface of the image carrier and a separation position where the cleaning member is separated from the image carrier; and a cleaning member moving section that carries out a predetermined measurement on the surface of the image carrier and moves the cleaning member from the separation position to the abutment position in accordance with a level of a current flowing in a direction from the surface to the base of the image carrier.

10. The image forming apparatus according to claim 9, the cleaning member moving section measures a current flowing in the direction from the surface to the base of the image carrier and determines a level of the current based on a measurement result.

11. The image forming apparatus according to claim 9, wherein the cleaning member moving section further comprises:

an electrode member that abuts against the surface of the image carrier;

a voltage applying section that applies a voltage to the electrode member; and a current measuring section that measures a current flowing between the electrode member and the base of the image carrier, wherein the level of the current is determined based on the current measurement result by the current measuring section.

12. The image forming apparatus according to claim 11, wherein the charger applies an electric charge to the image carrier by abutting against the image carrier, and the cleaning member moving section uses the charger as the electrode member.

13. The image forming apparatus according to claim 9, wherein the charger applies an electric charge to the image carrier by abutting against the image carrier, the cleaning member moving section comprises a current measuring section that measures a current flowing between the charger and the image carrier following the application of the electric charge, and the level of the current is determined based on a current measurement result by the current measuring section.

14. The image forming apparatus according to claim 9, comprising a removing member that removes the developed image remaining on the image carrier after the developed image is transferred from the image carrier.

* * * * *